United States Patent [19]

Vogel

[11] 4,398,075

[45] Aug. 9, 1983

[54] MECHANICAL SWITCH

[75] Inventor: Ernst Vogel, Basel, Switzerland

[73] Assignee: Elekto-Apparatebau Olten, A.G., Olten, Switzerland

[21] Appl. No.: 279,616

[22] Filed: Jul. 1, 1981

[30] Foreign Application Priority Data

Jul. 8, 1980 [CH] Switzerland ..... 5213/80

[51] Int. Cl.[3] ..... H01H 9/00; H01H 21/40

[52] U.S. Cl. ..... 200/314; 200/67 A; 200/159 R

[58] Field of Search ..... 200/314, 159 R, 159 A, 200/67 A

[56] References Cited

U.S. PATENT DOCUMENTS

| | | | |
|---|---|---|---|
| 1,502,785 | 7/1924 | Kerwin | 200/67 A |
| 2,020,733 | 11/1935 | Moehler | 200/159 R |
| 2,601,545 | 6/1952 | Miller | 200/159 R |
| 2,902,559 | 9/1959 | Morris | 200/159 R |
| 3,267,236 | 8/1966 | Walters et al. | 200/159 R |
| 3,394,403 | 7/1968 | Dennison | 200/314 |
| 3,514,565 | 5/1970 | Juéry | 200/314 |
| 3,585,557 | 6/1971 | Jorgenson | 200/67 A X |
| 3,867,596 | 2/1975 | Schadow | 200/314 X |
| 4,314,122 | 2/1982 | Bauer et al. | 200/67 A X |

FOREIGN PATENT DOCUMENTS

| | | | |
|---|---|---|---|
| 230467 | 4/1963 | Austria | 200/67 A |
| 686542 | 5/1964 | Canada | 200/159 R |
| 7713665 | 6/1979 | Netherlands | 200/67 C |
| 1315123 | 4/1973 | United Kingdom | 200/67 A |
| 641520 | 1/1979 | U.S.S.R. | 200/159 A |

*Primary Examiner*—Stephen Marcus
*Assistant Examiner*—Ernest G. Cusick
*Attorney, Agent, or Firm*—Kontler, Grimes & Battersby

[57] ABSTRACT

A miniature mechanical switch wherein an elongated tubular housing has a depressible pushbutton at one end and several terminals for connection to a control panel or the like at the other end. The housing confines a fixed contact and a pivotable second contact which is moved into engagement with the fixed contact in response to depression of the pushbutton through the medium of a restoring spring and a bell crank lever which is further biased by a resilient element to move the second contact away from the fixed contact in response to relaxation of pressure upon the pushbutton or in response to renewed depression of the pushbutton, depending upon whether the switch is a so-called momentary switch or a latching switch. The pivots for the lever and for the second contact are defined by a common carrier which forms part of a conductor connecting one of the terminals with the second contact. The fixed contact is connected with another terminal, and two additional terminals are connected with the socket for a light emitting diode located between the pushbutton and the pivot for the second contact. All of the conductors are substantially parallel to the axis of the housing.

22 Claims, 6 Drawing Figures

MECHANICAL SWITCH

BACKGROUND OF THE INVENTION

The present invention relates to mechanical switches in general, especially to switches which can constitute so-called momentary or so-called latching (alternate action) switches. More particularly, the invention relates to improvements in mechanical switches of the type wherein a second contact can be moved into engagement with or to a position of disengagement from a fixed first contact.

It is already known to provide a mechanical switch of the above outlined character with an elastic or resilient second contact which is pivotable between a first position of engagement with the fixed contact and a second position of engagement with a stop in the housing of the switch. It is also known to provide such switches with shiftable means for biasing the second contact to each of its two positions. The position of the second contact is changed by a motion transmitting system against the resistance of the biasing means in response to depression or another suitable movement of an actuating device, e.g., a pushbutton, whereby the biasing means moves through an intermediate dead-center position.

Mechanical switches of the above outlined character are furnished in different sizes but the diameter of their housing cannot be reduced below approximately 18 mm. This is not satisfactory for a number of applications, especially in various recent types of miniaturized circuits which necessitate the utilization of extremely compact switches with outer diameters constituting a small or minute fraction of 18 mm. The dimensions of component parts of presently known mechanical switches (including those described hereinbefore) cannot be reduced at will because such components must stand certain mechanical stresses and also because the number of materials for economical mass production of rugged but relatively or extremely small components for use in miniature mechanical switches is rather limited.

OBJECTS AND SUMMARY OF THE INVENTION

An object of the invention is to provide a mechanical switch which is at least as satisfactory (especially at least as rugged) as heretofore known mechanical switches but occupies only a small fraction of the space that is taken up by heretofore known switches.

Another object of the invention is to provide the improved switch with a housing whose maximum transverse dimension is only a fraction of 18 mm.

A further object of the invention is to provide a mechanical switch of the above outlined character which can be rapidly converted from a momentary switch to a latching switch or vice versa.

An additional object of the invention is to provide a mechanical switch wherein certain components are designed to perform plural functions and the components are installed and oriented in a novel and improved way to occupy only a fraction of the space that is taken up by similar or analogous components in heretofore known mechanical switches.

Another object of the invention is to provide an electric circuit which embodies one or more mechanical switches of the above outlined character.

An additional object of the invention is to provide a mechanical switch which is more compact than heretofore known switches even though it embodies or can embody a light source or an analogous signal generating device with appurtenant terminals, socket means and conductor means.

One feature of the invention resides in the provision of a mechanical switch, particularly a latching or momentary switch, which comprises an elongated tubular housing, a stationary first contact in the housing, an elongated (preferably elastic) second contact mounted in the housing for (preferably pivotal) movement between first and second positions of engagement with and disengagement from the first contact and extending in substantial parallelism with the longitudinal direction of the housing, resilient means for biasing the second contact to either of its positions, means for stressing the resilient means including bearing means (e.g., a portion of a bell crank lever) movable substantially transversely of the second contact between first and second end positions in which the resilient means respectively urges the second contact to the first and second positions (the bearing means is preferably further movable to a dead-center position intermediate its end positions), actuating means (e.g., a reciprocable pushbutton at one end of the housing) movable with reference to the housing from a starting position, and means for transmitting motion from the actuating means to the bearing means to thereby effect the movement of the bearing means between its end positions. The switch preferably further comprises stop means which is provided in the housing and against which the second contact abuts in the second position thereof. The resilient means is preferably installed in the housing in prestressed condition.

The novel features which are considered as characteristic of the invention are set forth in particular in the appended claims. The improved mechanical switch itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
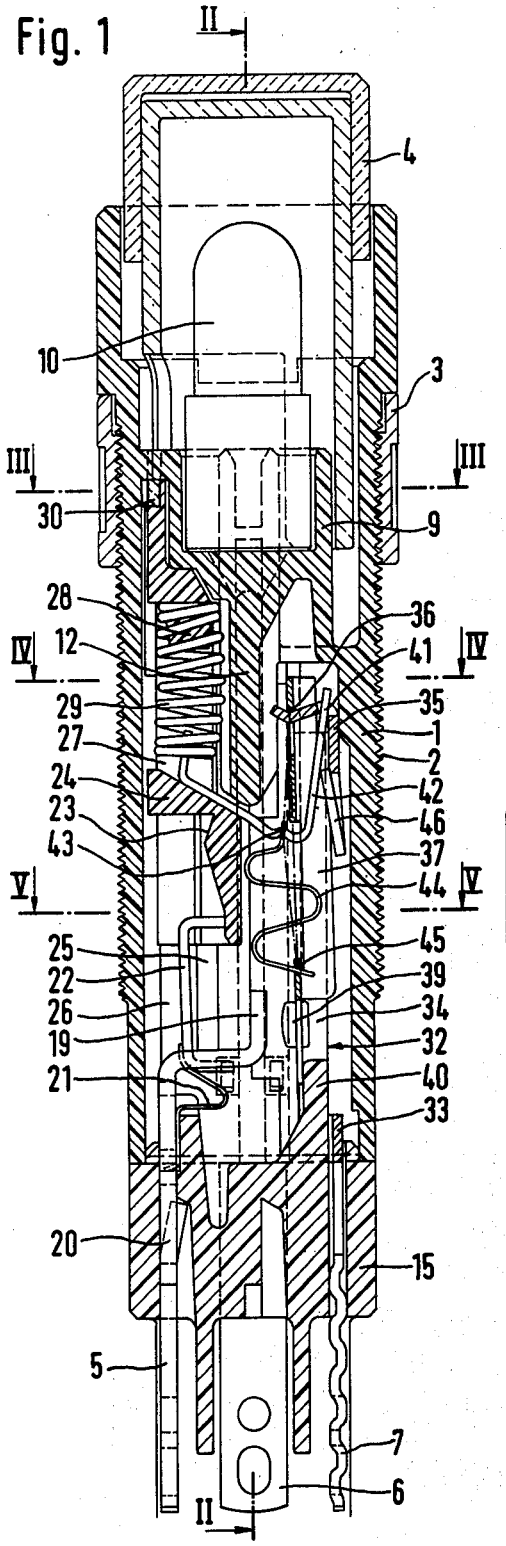
FIG. 1 is an axial sectional view of a mechanical switch which constitutes a latching switch and is shown in open position.

Referring to the drawing in detail, there is shown a mechanical switch which comprises a tubular (preferably cylindrical) housing 1 having an external thread 2 mating with the internal thread of an externally knurled positioning nut 3. The front end portion of the housing 1 (this is the upper end portion, as viewed in FIG. 1, 2 or 6) is provided with an actuating element in the form of a depressible pushbutton 4 which is movable in the longitudinal direction of the housing. The rear end portion of the housing 1 (i.e., the lower end portion, as viewed in FIGS. 1 and 2) has outwardly extending terminals 5, 6, 7, 8 which can be inserted into suitable sockets, not shown, of a control panel or the like. The exposed portions of the terminals 5 to 8 are parallel or substantially parallel to the longitudinal direction of the housing 1 which is preferably a slender tube or cylinder so as to occupy a minimal amount of space in a multiple-switch arrangement, e.g., in an arrangement of the type disclosed in U.S. Pat. No. 4,242,544 granted Dec. 30, 1980 to Hans E. Schweitzer.

Figure 2:
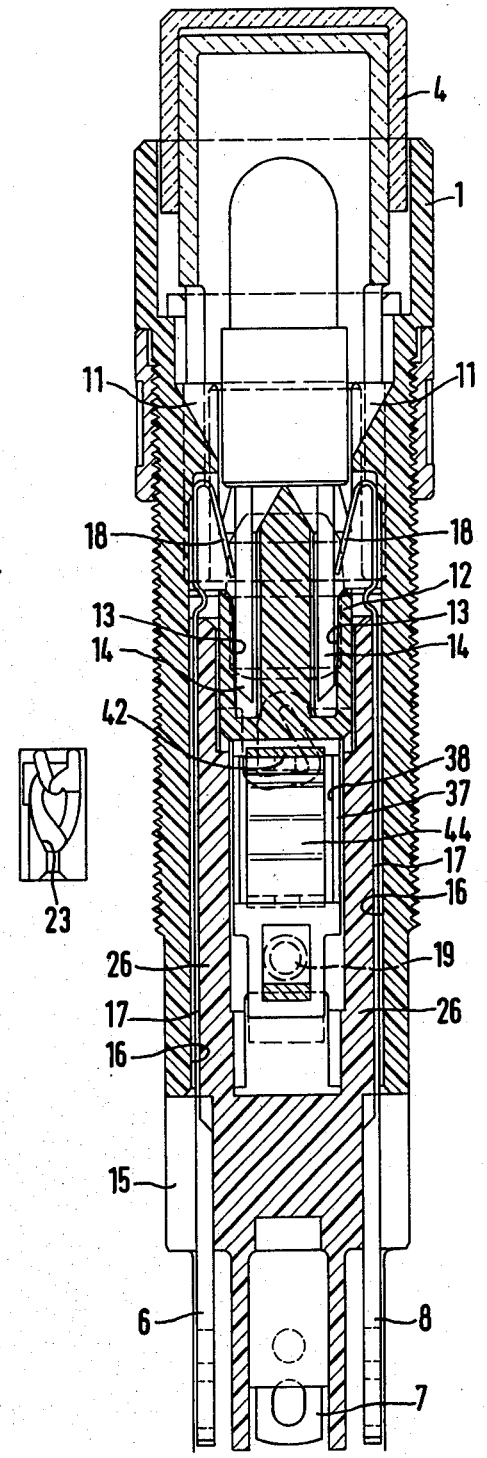
FIG. 2 is an axial sectional view as seen in the direction of arrows from the line II—II of FIG. 1 and illustrates the switch in closed position.

The upper portion of the housing 1 includes a one-piece socket or receptacle 9 for a signal generating device here shown as a light source 10, preferably a light-emitting diode, which extends into the interior of the actuating element 4 to illuminate the latter from the inside when the element 4 is depressed to complete one or more circuits and/or when the element 4 is held in the starting position of FIG. 1. The exact design of the light-emitting diode 10 forms no part of the present invention; this diode may have an axis which coincides with the longitudinal symmetry axis of the housing 1. The socket 9 has two wedge-like lateral slots 11 which facilitate insertion of a diode 10 into the socket and which further allow for grasping of the base of the diode 10 prior to extraction from the socket. Such extraction will take place upon removal of the actuating element 4, for example, in a manner as disclosed in U.S. Pat. No. 4,242,545 granted Dec. 30, 1980 to Hans E. Schweitzer.

The socket 9 of the housing 1 is followed by a sleeve-like extension 12 which is preferably made of one piece with the socket and has two parallel blind bores or holes 13 for contactors 14 of the diode 10. The housing 1 further comprises an insert 15 which is disposed at the rear end of the switch and defines two elongated channels 16 which are adjacent to the internal surface of the major portion of the housing 1 and serve to accommodate discrete elongated conductors 17. These conductors are located diametrically opposite each other with reference to the symmetry axis of the housing 1 (see FIG. 2) and are at least substantially parallel to such axis. The rear end portions of the two conductors 17 are connected with the terminals 6 and 8. The front end portions of the conductors 17 are bent, as at 18, and extend into the blind bores 13 to be engaged by the contactors 14 of a properly inserted light-emitting diode 10.

The terminal 5 is connected with a contact 19 which is fixedly mounted in the housing 1, and more particularly in the insert 15 of the housing. A conductor 20 which connects the terminal 5 with the fixed contact 19 extends in substantial parallelism with the symmetry axis of the housing 1 (see the left-hand portion of FIG. 1). A retaining spring 21 is provided to pivotally connect the fixed contact 19 with one leg of a U-shaped wire-like conducting member 22. The other leg of the U-shaped conducting member 22 extends into a groove 23 which is machined into or otherwise formed in a slide 24 reciprocable with the actuating element 4 in the axial direction of the housing 1. The slide 24 is reciprocable between guide portions in the form of two finger-like cheeks 26 which form part of the insert 15 and have elongated grooves 25 (see FIG. 1 or 5) for the complementary ribs of the slide 24. The two cheeks 26 are disposed at the opposite sides of a plane including the axis of the housing 1 (such plane is horizontal, as viewed in FIG. 5).

Figure 3:
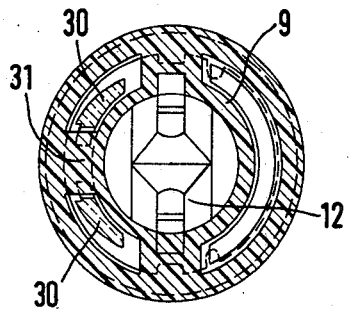
FIG. 3 is a transverse sectional view as seen in the direction of arrows from the line III—III of FIG. 1.

The slide 24 has a passage or channel 27 which is disposed between the groove 23 and the actuating element 4 to receive a projection or pin 28 serving to center one end portion of a motion transmitting device here shown as a restoring coil spring 29. The lowermost convolution of the spring 29, as viewed in FIG. 1, is adjacent to the slide 24. The actuating element 4 has two springy legs 30 which flank a bridge-like portion 31 of the housing 1 (see particularly FIG. 3). The inner end portions of the legs 30 are releasably coupled to the slide 24 so that the latter shares all axial movements of the actuating element 4. To this end, the lower end portions of the legs 30 (as viewed in FIG. 1) can be provided with inwardly extending teeth or jaws for reception in complementary recesses of the slide 24. The connection between the legs 30 and the slide 24 is sufficiently reliable to ensure that the slide 24 is depressed in response to depression of the actuating element 4 as well as that the slide 24 moves or can move upwardly, as viewed in FIG. 1 or 2, when the actuating element 4 is caused to reassume its starting or non-depressed position.

Figure 4:
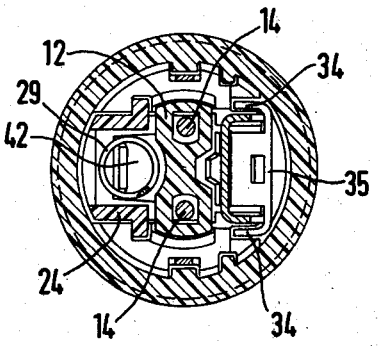
FIG. 4 is a transverse sectional view as seen in the direction of arrows from the line IV—IV of FIG. 1.
Figure 5:
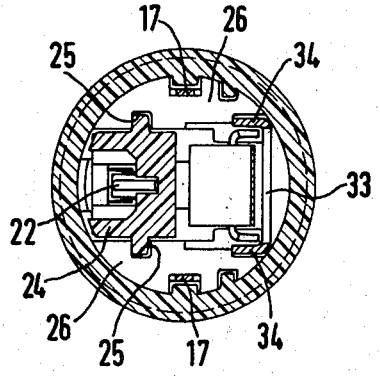
FIG. 5 is a transverse sectional view as seen in the direction of arrows from the line V—V of FIG. 1.

FIG. 1 shows that the slide 24 is disposed at one side of a plane which includes the symmetry axis of the housing 1 (such plane is vertical, as viewed in FIG. 4 or 5). The inert 15 is connected with a conductive carrier 32 which is rigid or integral with the fourth terminal 7 and is disposed at the other side of the just mentioned plane. The carrier 32 has a web 33 and two marginal portions or flanges 34 (see particularly FIGS. 4 and 5) which are disposed in parallel planes at right angles to the plane of the web 33 and constitute two conductors extending in parallelism with the symmetry axis of the housing 1. The conductors 34 are fixedly connected with each other by way of a supporting yoke 35 which defines a pivot or fulcrum 36 for an elongated frame-like elastic movable contact 37 having an opening or window 38. The contact 37 has a rivet 39 which can engage the fixed contact 19 or a stationary stop 40, depending on the momentary position of the movable contact 37. The rivet 39 is disposed at the lower end of the movable contact 37, as viewed in FIG. 1 or 2. The contact 37 is substantially parallel to the axis of the elongated housing 1 and, as mentioned above, is pivotable at 36 between two positions in one of which the rivet 39 engages the fixed contact 19 and in the other of which the rivet 39 bears against the stop 40 which latter forms an integral or separable part of the insert 15.

The supporting yoke 35 comprises a second pivot member or fulcrum 41 for a stressing device here shown as a bell crank lever 42 having a portion 43 which constitutes a bearing for an undulate resilient element 44. The axes of the fulcra 36 and 41 are parallel to each other. One arm of the bell crank lever 42 is substantially parallel to the movable contact 37; the other arm of this bell crank lever extends through the window 38 of the movable contact 37 and its free end portion is engaged by the restoring spring 29. The resilient element 44 engages the resilient movable contact 37 at 45. This element is disposed in the region of the window 38 between the lever 42 and the free lower end of the contact 37 (such free lower end carrying the rivet 39). It will be noted that the carrier 32 pivotally supports the contact 37 as well as the lever 42.

The supporting yoke 35 is rigidly connected to or integral with an abutment 46 (see the right-hand half of FIG. 1 at the level of the upper end portion of the resilient element 44). The abutment 46 is an elastic lamella and serves as a stop which determines one end position of the bell crank lever 42 (see also FIG. 6). The other end position of the bell crank lever 42 is determined by the motion transmitting device, i.e., by the restoring spring 29.

The operation:

When the mechanical switch of FIGS. 1 to 6 is idle, the resilient element 44 biases the bell crank lever 42 so that the latter bears against the restoring spring 29 (see FIG. 1) and the bearing 43 is held in one end position. In the idle condition of the mechanical switch which is shown in FIG. 1, the torque which the resilient element 44 applies to the bell crank lever 42 equals or exceeds the torque which the bell crank lever 42 receives from the restoring spring 29. If the torque which is applied by the resilient element 44 exceeds the torque of the spring 29 in idle position of the mechanical switch, the sleeve-like extension 12 of the housing 1 serves as an abutment or stop which holds the bell crank lever 42 against further pivotal movement under the action of the resilient element 44.

Figure 6:
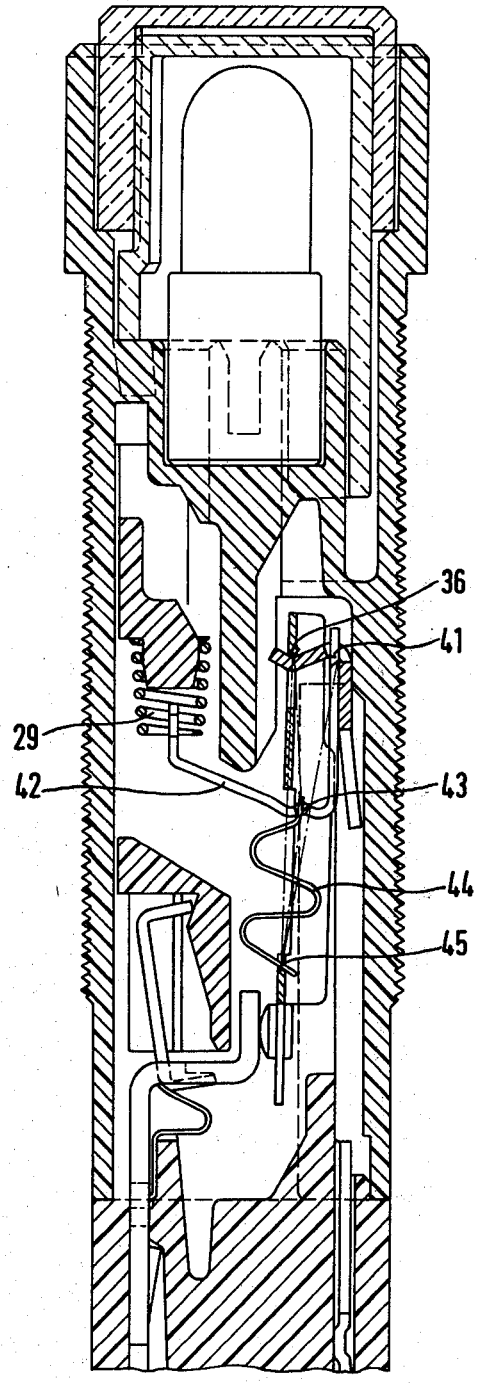
FIG. 6 is an enlarged view of a detail of the switch shown in FIG. 1 but showing the movable contact in engagement with the fixed contact.

If the operator decides to depress the actuating element 4, either directly or by remote control, the slide 24 shares the downward movement of the element 4, as viewed in FIG. 1, and the descending actuating element 4 causes the restoring spring 29 to store additional energy. Thus, the bias of the restoring spring 29 upon the respective arm of the bell crank lever 42 increases and ultimately exceeds the bias of the resilient element 44 upon the other arm of the lever 42. Consequently, the bell crank lever 42 is caused to pivot from the end position of FIG. 1 to the end position of FIG. 2 in which it engages the elastic abutment 46 of the supporting yoke 35. This causes the bearing 43 of the bell crank lever 42 to move from the one end position of FIG. 1, through a dead-center or neutral position (indicate by broken lines) and to the other end position which is shown in FIG. 6. The restoring spring 29 then continues to maintain the bell crank lever 42 in the end position of FIG. 6 against the opposition of the resilient element 44 so that the lever 42 bears against the abutment 46. This causes the resilient element 44 to store energy which is needed to return the lever 42 to the end position of FIG. 1. In order to enable the resilient element 44 to store the requisite amount of energy for effecting a return movement of the lever 42 to the end position of FIG. 1, the aforementioned other end position of the bearing 43 of the lever 42 must be located between the longitudinal axis of the movable contact 37 and a straight line extending from the locus 45 of engagement between the resilient element 44 with the contact 37 and the fulcrum or pivot 41 (see FIG. 6).

When the bearing 43 of the bell crank lever 42 moves beyond the aforementioned dead-center position, the resilient element 44 pivots the movable contact 37 to the end position which is shown in FIG. 6 and in which the switch is closed because the movable contact 37 (and more particularly its rivet 39) engages the fixed contact 19. In response to a first depression of the actuating element 4, the slide 24 is held by the member 22 which extends into the groove 23. When the actuating element 4 is depressed again, the member 22 releases the slide 24, and the restoring spring 29 pushes the actuating element 4 upwardly to its starting position whereby the restoring spring 29 dissipates a certain amount of energy. This reduces the bias of the spring 29 upon the bell crank lever 42 to such an extent that the lever 42 can pivot under the combined action of the resilient element 44 and elastic abutment 46. Consequently, the bearing 43 of the bell crank lever 42 is moved from the end position of FIG. 6, through the dead-center position and back to the end position of FIG. 1 substantially transversely of the elongated contact 37. When the bearing 43 of the lever 42 moves beyond the dead-center position, the resilient element 44 automatically pivots the movable contact 37 so that the latter moves its rivet 39 away from the fixed contact 19 and against the stop 40. Thus, the switch is open again.

The aforediscussed positioning of the carrier 32 with reference to the springy movable contact 37 and their mounting at one side of a plane including the axis of the housing 1, and the mounting of the restoring spring 29 and slide 24 at the other side of such plane, in combination with the provision of the multiple-purpose or multifunction lever 42, renders it possible to construct the mechanical switch in the form of a highly compact body. The compactness of the improved switch is further enhanced by the aforediscussed cooperation of the resilient element 44 with the movable contact 37 as well as by the aforediscussed cooperation of the restoring spring 29 with the slide 24. In spite of the relatively large number of parts therein, the small-diameter housing 1 still provides room for the signal generating means including the diode 10.

The illustrated mechanical switch is a so-called alternate-action or latching switch, i.e., a first depression of the actuating element 4 will entail engagement of the contacts 19, 37 and such contacts are separated from each other in response to renewed depression of the element 4. By the simple expedient of removing the resilient member 22, the illustrated latching switch can be converted into a so-called momentary switch wherein the contacts 19, 37 remain in engagement only as long as the actuating element 4 is held in the depressed position.

An important advantage of the improved switch is that all or nearly all conductors extend in substantial parallelism with the longitudinal symmetry axis of the tubular housing 1 (such axis can be said to coincide with the line II—II of FIG. 1). This renders it possible to reduce the diameter of the housing 1 and hence the overall dimensions of the switch. The terminals 5 to 8 are readily accessible as soon as the lower end portion of the housing 1 is detached from a control panel, a switchboard or an analogous support.

The dimensions of the improved switch can be reduced still further in view of the fact that the lever 42 is pivotable about an axis (41) which is at least substantially parallel to the pivot axis (36) of the second contact 37. The bearing 43 for the resilient element 44 is defined by the lever 42 one arm of which is biased by the restoring spring 29 and the other arm of which extends through the window 38 and is biased by the resilient element 44 against the bias of the spring 29. The bearing 43 is movable substantially transversely of the contact 37 which, in turn, is substantially parallel to the axis II—II. The conductors 17 are disposed substantially diametrically opposite each other with reference to the axis II—II, and the axis of the restoring spring 29 is substantially parallel to the axis II—II and is disposed substantially midway between the conductors 17, as considered in the circumferential direction of the housing 1. These features also contribute to compactness of the improved switch.

An advantage of pivotally mounting the contact 37 and the lever 42 on a common carrier 32 is that the bearing 43 of the lever 42 can be placed close to the contact 37 (see FIG. 1). Moreover, the fulcrum 41 can be installed in the region of the free end portion of the right-hand arm of the lever 42 (as viewed in FIG. 1), and the left-hand arm of the lever 42 can form part of the motion transmitting system which further includes the restoring spring 29 and serves to move the bearing 43 from the one to the other end position in response to depression of the actuating element 4. The just discussed features of the parts 32, 42 and 29 contribute to compactness of the switch because the lever 42 can perform several functions (i.e., it can replace two or more components which are needed in a conventional switch) and also because the components can be installed close to each other whereby such closely adjacent components do not interfere but rather cooperate with one another. The carrier 32 also performs several material- and space-saving functions, i.e., it provides the fulcra 36, 41 for the contact 37 and lever 42, and it further forms part of the conductor means connecting the contact 37 with the terminal 7.

The feature that one arm of the lever 42 extends in substantial parallelism with the axis (II—II) of the housing 1 further contributes to compactness of the switch because this renders it possible to move several components nearer to such axis and to thus allow for a reduction of the diameter of the housing 1. The frame-like contact 37 defines the window (38) through which the right-hand arm of the lever 42 (as viewed in FIG. 1) extends; this arm is pivotable to share the movements of the bearing 43 between the two end positions under the action of the restoring spring 29 or resilient element 44. As also shown in FIG. 1, the fulcra 36 and 41 are located at one side and the restoring spring 29 is located at the other side of the axis II—II. This renders it possible to place the right-hand arm of the lever 42 between the contact 37 and the right-hand portion of the housing 1 whereas the left-hand arm of the lever 42 extends, in part, substantially diametrically of the housing 1 and toward the lowermost convolution of the restoring spring 29. This contributes to proper utilization of space in the region of the lever 42 while providing room for the conductors which extend to the contactors 14 of the diode 10 as well as for the restoring spring 29.

The carrier 32 performs the additional function of holding the lever 42 in one of its end positions. This will be readily appreciated since the elastic abutment 46 forms part of the carrier 32. The other end position of the lever 42 is determined by the restoring spring 29. Thus, the parts 32 and 39 perform the just outlined additional functions with attendant savings in place and a reduction of the overall number of parts. The mounting of the resilient element 44 in the aforedescribed manner between the free lower end of the contact 37 and the bearing 43 in the region of the window 38 also contributes to compactness of the switch without impeding the movements of the lever 42, contact 37, element 44 and restoring spring 29.

It goes without saying that the dimensions of the improved switch can be reduced still further by omitting the diode 10, it socket 9 and the corresponding terminals and conductors. However, the provision of a light source is often desirable or highly advantageous so that it warrants a slight increase of the dimensions (especially of the length) of the housing 1. Furthermore, the aforediscussed placing of the socket 9 between the actuating element 4 and the fulcrum 36 for the contact 37 as well as the mounting of the conductors 17 diametrically opposite each other with reference to the axis II—II contributes to compactness of the parts which constitute and cooperate with the light source.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. In a mechanical switch, the combination of:

(a) an elongated tubular housing;

(b) a first contact in said housing;

(c) an elongated second contact in said housing mounted for pivotal movement about a preselected axis between first and second positions of engagement with and disengagement from said first contact, said second contact extending at least approximately parallel to the longitudinal direction of said housing;

(d) resilient means for biasing said second contact to either of said positions;

(e) means for stressing said resilient means including a lever having a first arm which extends at least approximately parallel to the longitudinal direction of said housing and a second arm, each of said arms having a free end, and said lever being mounted in the region of one of said free ends for pivotal movement about a predetermined axis which is at least approximately parallel to said preselected axis, said lever defining bearing means movable transversely of said second contact between first and second end positions in which said resilient means respectively urges said second contact to said first and second positions;

(f) actuating means movable with reference to said housing from a starting position; and (g) means for transmitting motion from said actuating means to said lever to thereby effect movement of said bearing means between said end positions, said motion transmitting means including resilient restoring means for said actuating means, and said restoring means bearing against said lever in the region of the other of said free ends.

2. The combination of claim 1, wherein said second contact is elastic.

3. The combination of claim 2, further comprising a stop provided in said housing, said second contact abutting against said stop in said second position thereof.

4. The combination of claim 3, wherein said resilient means is installed in said housing in prestressed condition and is operative to move said bearing means, in response to movement of said actuating means from starting position, from one of said end positions, through an intermediate dead-center position, and to the other of said end positions.

5. The combination of claim 1, wherein said housing has first and second end portions, said actuating means being disposed at said first end portions; and further comprising a plurality of terminals disposed at said second end portion and conductor means connecting said terminals with said contacts, said conductor means being installed in and extending substantially lengthwise of said housing.

6. The combination of claim 1, wherein said restoring means comprises a restoring spring.

7. The combination of claim 1, wherein said restoring spring 15 arranged to pivot said lever in a first direction and said resilient means 15 arranged to pivot said lever in a second direction counter to said first direction so that said bearing means is moved to one of said end positions under the action of said restoring spring in response to movement of said actuating means from its starting position and to the other of said end positions under the action of said resilient means when the bias of said restoring spring is reduced.

8. The combination of claim 7, wherein the bias of said restoring spring upon said lever in the starting position of said actuating means is less than the bias of said resilient means but exceeds the bias of said resilient means in response to movement of said actuating means from said starting position.

9. The combination of claim 1, further comprising a common carrier on which said second contact and said lever are mounted.

10. The combination of claim 9, wherein said housing has a first and a second end portion, said actuating means being disposed in the region of said first end portion; and further comprising terminals provided at said second end portion and conductor means connecting said terminals with said contacts, said common carrier forming part of said conductor means.

11. The combination of claim 10, wherein said conductor means includes a conductor connecting one of said terminals with said second contact and said carrier forms part of said conductor.

12. The combination of claim 1, wherein said second contact has a window for said second arm.

13. The combination of claim 1, wherein said housing has a symmetry axis, said predetermined axis and said preselected axis being disposed at one side and said restoring means being disposed at the other side of said symmetry axis.

14. The combination of claim 1, wherein said second contact has a window for said second arm, said second contact having a free end portions and said resilient means being disposed between said lever and said free end portions in the region of said window.

15. The combination of claim 1, wherein said housing has first and second end portions and said actuating means is disposed in the region of said first end portion; and further comprising a light source installed in said housing between said preselected axis and said first end portion.

16. The combination of claim 15, wherein said housing includes a socket for said light source; and further comprising terminals mounted in said housing in the region of said second end portion and conductor means extending in said housing between said socket and said terminals.

17. The combination of claim 16, wherein said housing has a symmetry axis and said terminals include first and second terminals disposed diametrically opposite each other with reference to said symmetry axis.

18. The combination of claim 17, wherein said restoring means comprises a coil spring having an axis substantially parallel to said symmetry axis and located substantially midway between said first and second terminals, as considered in the circumferential direction of said housing.

19. The combination of claim 1, wherein said resilient means bears against said second contact and against said bearing means.

20. The combination of claim 1, wherein said predetermined axis is located in the region of said preselected axis.

21. In a mechanical switch, the combination of an elongated tubular housing; a first contact in said housing; an elongated second contact mounted in said housing for movement between first and second positions of engagement with and disengagement from said first contact, said second contact extending in substantial parallelism with the longitudinal direction of said housing; resilient means for biasing said second contact to either of said positions; a lever for stressing said resilient means pivotable in said housing about a predetermined axis, said lever including bearing means movable substantially transversely of said second contact between first and second end positions which said resilient means respectively urges said second contact to said first and second positions; actuating means movable with reference to said housing from a starting position; means for transmitting motion from said actuating means to said bearing means to thereby effect movement of said bearing means between said end positions, said motion transmitting means comprising resilient restoring means interposed between said actuating means and said lever, and said restoring means cooperating with said lever to determine one end position of said bearing means; and a resilient abutment in said housing, said lever engaging said abutment in the other end position of said bearing means.

22. The combination of claim 21, wherein said second contact is pivotable about a second axis which is at least substantially parallel to said predetermined axis; and further comprising a common carrier on which said lever and said second contact are mounted, said carrier defining said axes and including said resilient abutment.

* * * * *